United States Patent [19]

Müller

[11] 4,401,299

[45] Aug. 30, 1983

[54] DEVICES FOR ACCELERATING SHEETS IN GATHERING MACHINES

[75] Inventor: Hans Müller, Zofingen, Switzerland

[73] Assignee: Grapha-Holding AG, Hergiswil, Switzerland

[21] Appl. No.: 287,173

[22] Filed: Jul. 27, 1981

[30] Foreign Application Priority Data

Jul. 28, 1980 [CH] Switzerland ..... 5750/80

[51] Int. Cl.[3] ..... B65H 39/02; B65H 39/055

[52] U.S. Cl. ..... 270/54; 270/58

[58] Field of Search ..... 270/54, 58

[56] References Cited

U.S. PATENT DOCUMENTS

| | | | |
|---|---|---|---|
| 2,173,118 | 9/1939 | Krueger | 270/54 |
| 2,711,897 | 6/1955 | Grunlee | 270/54 X |
| 2,793,032 | 5/1957 | Van Dusen | 270/58 |
| 3,175,821 | 3/1965 | Gibson | 270/58 |
| 3,311,368 | 3/1967 | Sarring | 270/54 |

FOREIGN PATENT DOCUMENTS

| | | | |
|---|---|---|---|
| 2035964 | 6/1980 | United Kingdom | 270/58 |

*Primary Examiner*—A. J. Heinz

*Attorney, Agent, or Firm*—Kontler, Grimes & Battersby

[57] ABSTRACT

A gathering machine wherein the platforms for deposition of sheets prior to accumulation into piles on the horizontal track of the conveyor system are of adjustable width so as to properly confine and guide wider or narrower sheets. Each sheet which rests on a platform is accelerated prior to removal from the platform by the oncoming prong of a series of equidistant prongs on an endless chain which forms part of the conveyor system. The accelerating devices are elongated elastic bars having rectangular sheet-engaging undersides which bear against the upper sides of sheets on the respective platforms and accelerate the sheets in the direction of travel of the oncoming prongs shortly before the sheets are engaged by the prongs. The platforms carry recessed idler rollers below the respective accelerating devices to reduce friction between the sheets and the platforms during acceleration of the sheets by the undersides of the accelerating devices. The drives for the accelerating devices receive motion from a main shaft which drives transfer wheels serving to remove sheets from discrete magazines and to advance the sheets in directions toward the respective platforms. During the last stage of travel of sheets from the magazines onto the respective platforms, the sheets are guided by pairs of endless belts one of which serves to orbit the respective accelerating device along an endless path and receives motion from the main shaft.

21 Claims, 3 Drawing Figures

DEVICES FOR ACCELERATING SHEETS IN GATHERING MACHINES

BACKGROUND OF THE INVENTION

The present invention relates to machines for gathering paper sheets or the like, and more particularly to improvements in gathering machines of the type wherein a conveyor system advances sheets along an elongated path past a succession of magazines for different types of sheets and each magazine is associated with a transfer device which removes sheets from the magazine and delivers them into the range of the conveyor system so that the latter accumulates piles of dissimilar sheets which are ready for conversion into pamphlets, brochures, books or like products.

It is already known to provide a platform or an analogous support between each transfer device and the conveyor system so that sheets which are delivered by the transfer devices come to rest on the respective platforms prior to being entrained by the conveyor system, namely, by fingers, prongs or analogous entraining elements which are provided on an endless chain or the like and strip the sheets off the respective platforms to transfer them onto partly assembled piles of sheets on an elongated track along which the piles advance toward the discharge end of the gathering machine. Reference may be had to my commonly owned copending application Ser. No. 094,321 filed Nov. 14, 1979 for "Gathering machine for paper sheets or the like".

A drawback of presently known gathering machines is that the orientation of sheets is likely to change during transport from the magazines to the respective platforms, i.e., while the sheets advance with or beyond the components of the transfer devices and before the sheets are actually engaged and entrained by the conveyor system. The likelihood of improper orientation is especially pronounced if the sheets are large or thin and if their weight is low. The orientation of a partly misoriented sheet is likely to change again during removal of such sheet from the respective platform, i.e., during transfer onto the aforementioned track under the action of an oncoming entraining element of the conveyor system. As a rule, such secondary change of orientation will involve turning of sheets in response to acceleration in the longitudinal direction of the conveyor system.

The aforementioned copending application Ser. No. 094,321 further discloses hold-down devices which are associated with the platforms and serve to accelerate the sheets prior to engagement of sheets by the oncoming entraining prongs. The hold-down devices engage the upper sides of sheets on the respective platforms shortly before such sheets are engaged by the oncoming prongs to ensure that the sheets are held in proper positions prior to and/or during transport away from the platforms and onto the track of the conveyor system. The arrangement is preferably such that the hold-down devices orbit along endless paths above the upper sides of the respective platforms. At the same time, the hold-down devices can perform an accelerating action, i.e., they can shift the sheets in the direction of removal from the respective platforms.

A drawback of presently known gathering machines is that relatively large sheets are particularly likely to change their orientation during removal from and/or during delivery onto the platforms. This results in the assembly of unsatisfactory piles wherein the sheets are not accurately alined with each other. The causes of misorientation are numerous. For example, relatively large sheets can be misoriented by the accelerating and hold-down devices of the above outlined character because they do not engage sufficiently large portions of the upper sides of sheets on the respective platforms. Alternatively, or in addition to misorientation under the action of the hold-down devices, relatively large sheets can be misoriented during engagement of their trailing edges by the oncoming prongs of the conveyor system.

OBJECTS AND SUMMARY OF THE INVENTION

An object of the invention is to provide a novel and improved gathering machine which is constructed and assembled in such a way that the likelihood of misorientation of sheets during transfer from the magazines onto the associated platforms and/or during removal from the platforms is much more remote than in heretofore known machines even if the improved machine is operated at an elevated or extremely high speed.

Another object of the invention is to provide a gathering machine of the just outlined character which can manipulate lightweight and/or large or very large sheets at a higher speed and with a higher degree of reproducibility than heretofore known gathering machines.

A further object of the invention is to provide the gathering machine with novel and improved means for controlling the positions of sheets during transfer from the platforms onto the conveyor system.

Another object of the invention is to provide the gathering machine with novel and improved means for conversion from the processing of narrower sheets to the processing of wider sheets or vice versa.

An additional object of the invention is to provide the gathering machine with novel and improved means for positively guiding sheets all the way from the magazines to and beyond the supporting surfaces of the respective platforms so that the likelihood of misorientation of sheets during such transport is practically nil irrespective of the speed at which the machine gathers dissimilar sheets into piles for conversion into pamphlets, brochures or the like.

Another object of the invention is to provide the gathering machine with novel and improved means for adjusting the dimensions of the platforms which support the sheets preparatory to engagement and entrainment of sheets by the prongs, fingers or analogous entraining elements of the conveyor system.

Another object of the invention is to provide the gathering machine with novel and improved means which assist in proper removal of sheets from the platforms.

A further object of the invention is to provide a gathering machine wherein each and every sheet reaches the conveyor system in the same orientation as all preceding sheets and wherein proper orientation of sheets is not contingent upon their size and/or shape.

An ancillary object of the invention is to provide the gathering machine with novel and improved means for affording convenient access to the conveyor system.

Another object of the invention is to provide a gathering machine which can accumulate piles of accurately overlapping sheets at a speed which is much higher than permissible or possible in heretofore known gathering machines.

One feature of the invention resides in the provision of a machine for gathering sheets into piles or similar accumulations. The machine comprises a conveyor having a plurality of spaced-apart entraining means (preferably equidistant fingers, pushers or prongs) which are mounted for movement in a predetermined direction and along an elongated first predetermined path, a succession of platforms or analogous supports adjacent to the elongated path and disposed one after the other, as considered in the direction of travel of entraining means along the elongated path, each support being provided with a sheet supporting surface which may but need not be horizontal or which may include horizontal and non-horizontal portions, transfer means which is operable to deliver sheets to the surfaces of the supports so that the thus delivered sheets extend into the elongated path and are removed from the supports by the oncoming entraining means (the transfer means preferably comprises at least one discrete rotary transfer member for each support, and each transfer member has one or more grippers or analogous means for withdrawing sheets from discrete magazines or analogous sources of supply), and novel and improved sheet accelerating devices, at least one for each of the supports and each movable along an endless second path at a level above the surface of the respective support. Each second path has a predetermined portion (particularly the lowermost portion thereof) which is sufficiently close to the respective supporting surface to enable the corresponding accelerating device to frictionally engage the sheet on the adjacent supporting surface, and each accelerating device has an elongated sheet-engaging surface which is at least substantially parallel to the direction of travel of entraining means along the first path. The machine preferably further comprises sets of idler rollers and/or other suitable means for reducing friction between the surfaces of the supports and the sheets in the regions of the aforementioned predetermined portions of the respective second paths, drive means which are operable to move the accelerating devices along the respective second paths so that the accelerating devices move in the direction of travel of entraining means along the first path during travel of the accelerating devices along the aforementioned predetermined portions of the respective second paths, and means (e.g., a continuously driven main shaft) for operating the drive means in synchronism with the transfer means so that each accelerating device engages and accelerates a freshly delivered sheet on the surface of the respective support not later than on engagement of such sheet by the oncoming entraining means.

The elongated sheet-engaging surfaces of the accelerating devices (each such device may constitute a bar consisting of rubber or another elastomeric or deformable material) are preferably elongated rectangular surfaces and such rectangular surfaces preferably constitute the undersides of the respective accelerating devices.

Each support is preferably assembled of several portions and at least one portion of each support is preferably movable substantially transversely of the direction of travel of entraining means along the first path and with reference to the other portion(s) of the respective support to thereby change the effective width of the corresponding supporting surface. This ensures that the gathering apparatus can be used for accumulation of piles consisting of wider or narrower sheets.

Each support preferably comprises two spaced apart marginal guide portions (one of which may include the aforementioned movable portion) which extend in parallelism with the direction of travel of entraining means along the first path and are disposed at the opposite sides of the first path. The supporting surfaces are located between the respective pairs of marginal guide portions which serve to prevent changes of orientation of sheets during removal from the supports by the oncoming entraining means.

Each of the aforementioned drive means preferably comprises a pair of parallel links having first end portions which are articulately connected with spaced-apart portions of the respective accelerating devices and second end portions which are rotated by suitable rotating means about parallel axes extending transversely of the direction of movement of entraining means along the first path to thereby move the respective accelerating devices along the corresponding endless second paths. Each of the rotating means may comprise at least one endless toothed belt or an analogous flexible element which receives motion from the operating means. As mentioned above, the operating means can comprise a main shaft which preferably extends in parallelism with the direction of travel of entraining means along the first path and drives the aforementioned rotary transfer members of the transfer means.

The machine preferably further comprises sheet guiding devices which are interposed between the rotary transfer members and the respective supports and serve to positively guide the sheets during transport from the respective transfer members onto the surfaces of the associated supports. The aforementioned flexible elements may constitute component parts of the respective sheet guiding devices. Each sheet guiding device can comprise at least one second endless flexible element which can be driven by the associated first mentioned endless flexible element. The second flexible elements then cooperate with the corresponding first mentioned flexible elements to define elongated third paths along which the sheets are advanced from the rotary transfer members onto the surfaces of the respective supports. The cooperating flexible elements preferably include elongated neighboring reaches or stretches which define the respective third paths and positively engage the adjacent sides of a sheet which is to be advanced from the respective transfer member onto the surface of the corresponding support.

The machine can be further provided with means for moving the supports with reference to (toward or away from) the conveyor. Such moving means can comprise one or more fluid-operated motors (e.g., pneumatic cylinder and piston units) which can pivot the supports about axes extending in parallelism with the direction of travel of entraining means along the first path.

The feature that the supports consists or are assembled of several portions at least one of which is adjustable with reference to the other portion or portions of the same support to thus change the width of supporting surfaces can be resorted to independently of the feature that the machine employs elongated bar-shaped or analogous accelerating devices. In other words, a gathering machine can embody the improved accelerating devices and/or supports which include one or more movable portions. Furthermore, each support may but need not necessarily be provided with two marginal guide portions which even further reduce the likelihood of misorientation of sheets during travel along and off the supporting surfaces.

The novel features which are considered as characteristic of the invention are set forth in particular in the appended claims. The improved gathering machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
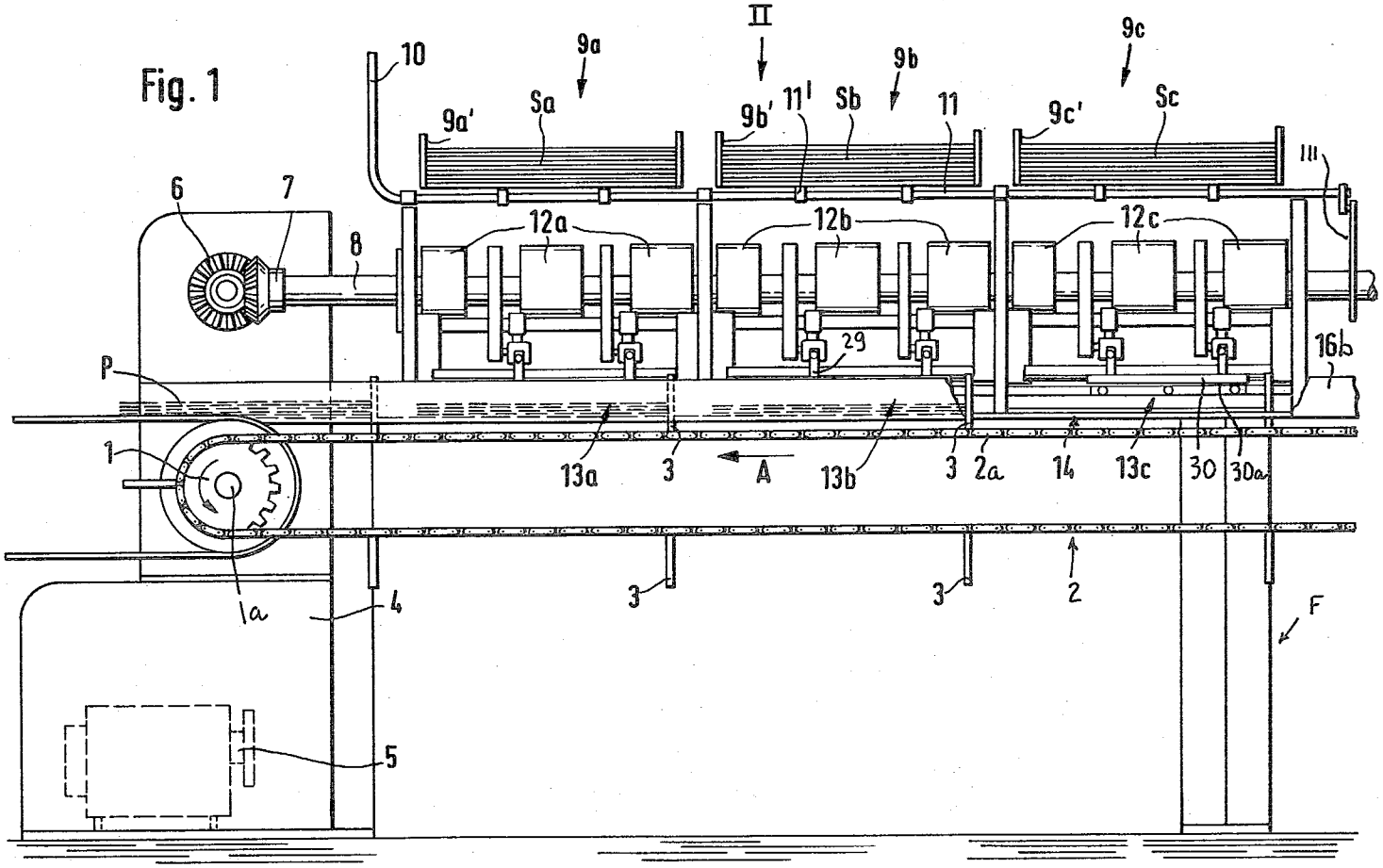
FIG. 1 is a fragmentary schematic elevational view of a gathering machine which embodies the invention.

Referring first to FIG. 1, there is shown a portion of a gathering machine which comprises a conveyor including an endless chain 2 trained over sprocket wheels 1 (only one shown) and having a plurality of equidistant entraining means or prongs 3 which, during travel with the upper reach 2*a* of the chain 2, advance along a horizontal path and in a predetermined direction, namely, to the left as indicated by the arrow A. The conveyor further comprises a horizontal track 14 which is installed in the frame F of the gathering machine at a level above the upper reach 2*a* and has an elongated horizontal slot 15 (see FIGS. 2 and 3) for the prongs 3 so that the oncoming prongs can push sheets B along the upper side of the track 14 during travel of such prongs with the upper reach 2*a*.

The illustrated sprocket wheel 1 is mounted on a housing 4 the lower portion of which confines a main prime mover 5 (e.g., a variable-speed electric motor) which drives the shaft 1*a* for the sprocket wheel 1 as well as a first bevel gear 6 rotatably mounted on the housing 4 at a level above the chain 2. The bevel gear 6 transmits torque to a mating bevel gear 7 which drives a horizontal main shaft 8 extending in parallelism with and at a level above the upper reach 2*a* of the chain 2. The exact manner in which the output element of the prime mover 5 transmits torque to the shaft 1*a* and to the shaft of the bevel gear 6 forms no part of the invention and is not shown in the drawing.

Figure 2:
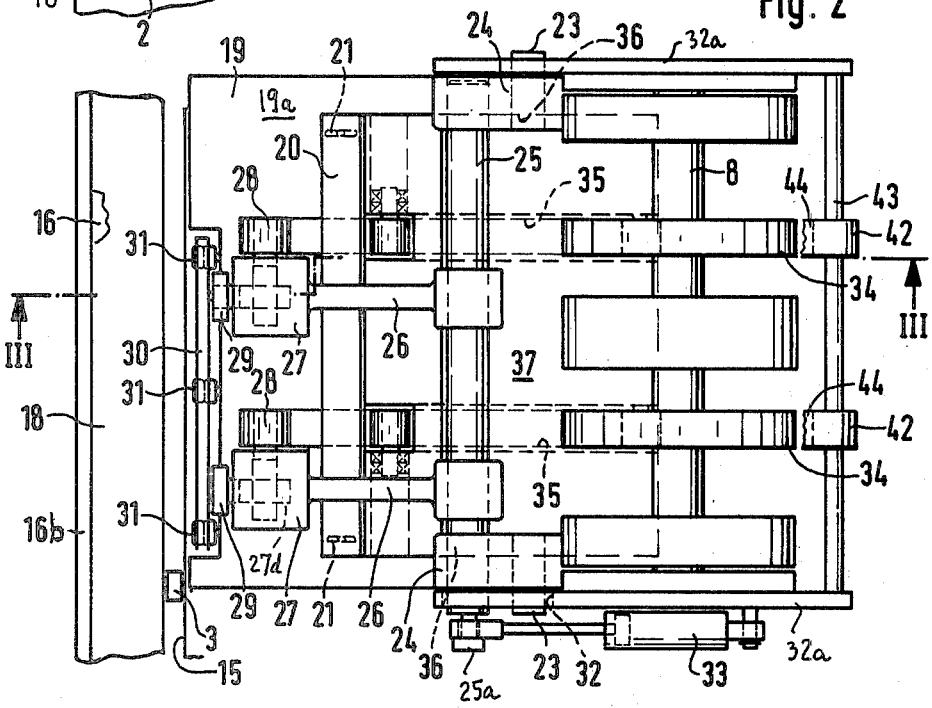
FIG. 2 is an enlarged plan view as seen in the direction of arrow II in FIG. 1, with the corresponding magazine omitted.

The main shaft 8 transmits motion to the moving parts of a series of sheet delivering units or feeders including those shown at 9*a*, 9*b* and 9*c*. Each feeder comprises a magazine (including those shown at 9*a*′, 9*b*′, 9*c*′) for a discrete stack (Sa, Sb, Sc) of paper sheets B. Each paper sheet B may be a folded sheet so that it comprises a pair of overlapping panels or sections with a back BR where the two sections are connected to each other, or each of the sheets B may constitute a single planar body. The transfer means for removing sheets B from the magazines 9*a*′ to 9*c*′ comprises transfer devices 12*a*, 12*b*, 12*c* each of which serves to deliver successive sheets from the respective magazine to the associated platform or support 13*a*, 13*b* or 13*c*. These platforms are mounted at a level above the track 14 of the conveyor including the chain 2. The manner in which the transfer devices 12*a*–12*c* remove sheets B from the respective magazines 9*a*′–9*c*′ is or may be analogous to that shown and described in the aforementioned copending application Ser. No. 094,321 or in my commonly owned U.S. Pat. Nos. 4,085,927 and 4,221,373 respectively granted Apr. 25, 1978 and Sept. 9, 1980. FIGS. 1 and 2 merely show a horizontal suction pipe which is connected with a suction generating device (not shown) by a further pipe 10 and carries a series of suction cups or heads 11′, two for each of the magazines 9*a*′ to 9*c*′. The pipe 11 is turnable about its own axis which is parallel to the axis of the shaft 8, and the suction cups 11*a*′ are connected with the suction generating device while the pipe 11 turns in a clockwise direction, as viewed in FIG. 3, so that each pair of suction cups 11′ extracts the adjacent edge portion or back BR of the lowermost sheet B in the corresponding magazine and flexes such back into the range of one or more grippers 17 on a rotary drum-shaped transfer member 12′ of the respective transfer device 12*a*, 12*b* or 12*c*.

The means for driving the transfer members 12′ at a predetermined peripheral speed (in the direction indicated in FIG. 3 by the arrow AA) is the shaft 8 which further transmits motion to a rocking device 111 for the suction pipe 11 and its suction cups 11′. The arrangement is such that, during each revolution of a transfer member 12′, the associated gripper or grippers 17 engage the downwardly flexed back BR of the lowermost sheet B in the associated magazine 9*a*′, 9*b*′ or 9*c*′ and extract such sheet from the magazine prior to advancing the extracted sheet toward the upper surface of the respective platform or support 13*a*, 13*b* or 13*c*. The track 14 which is disposed between the platforms 13*a*–13*c* and the upper reach 2*a* of the chain 2 comprises two parallel elongated sections or rails 16 and 16*a* with the aforementioned slot 15 therebetween (see FIG. 3).

As mentioned above, each revolution of the shaft 8 entails the removal of a sheet B from each of the magazines 9*a*′, 9*b*′, 9*c*′ (and from the remaining magazine or magazines if the gathering machine comprises more than three feeders), and such sheets are caused to descend onto the respective supports or platforms 13*a*, 13*b*, 13*c* to be removed by the oncoming prongs 3 and transferred onto the track 14. The latter accumulates a series of growing piles or stacks each of which consists of dissimilar sheets, i.e., each such pile comprises a sheet B from the magazine 9*a*′, a sheet B from the magazine 9*b*′, a sheet B from the magazine 9*c*′, and so forth. A fully assembled pile is shown at P in the left-hand portion of FIG. 1 at a level above the sprocket wheel 1. Such pile can be converted into a brochure, a pamphlet, a book or the like in a manner not forming part of the present invention. The rotary movements of the transfer members 12′ and the speed of the chain 2 are synchronized in such a way that, when a sheet B is pushed off the respective platform or support 13*a*, 13*b* or 13*c* under the action of the oncoming prong 3, its leader tends to drop onto the upper side of the track 14 but, instead, comes to rest on the partially assembled pile which advances along the upper side of the track 14 so that each partially assembled pile is augmented by an additional sheet during travel below and beyond successive platforms 13*c*, 13*b*, 13*a*. The two sections 16, 16*a* of the track 14 preferably consist of a suitable metallic material and can be mutually inclined in a manner as shown in the left-hand portion of FIG. 3. The flange 16*b* of the section 16 serves as a marginal guide portion, i.e., as a means for maintaining the sheets B of successive piles in proper alinement with one another.

If the sheets B are folded sheets so that each thereof comprises two overlapping panels, the edge portions BR are preferably the backs where the two panels are integrally connected to each other. Thus, each of the grippers 17 engages the back BR of a folded sheet B, namely, that edge portion which is flexed downwardly by the respective suction cups 11' during orbital movement of the oncoming gripper or grippers 17 along that portion of the respective endless path which is nearest to the outlet of the corresponding magazine 9a', 9b' or 9c'.

Figure 3:
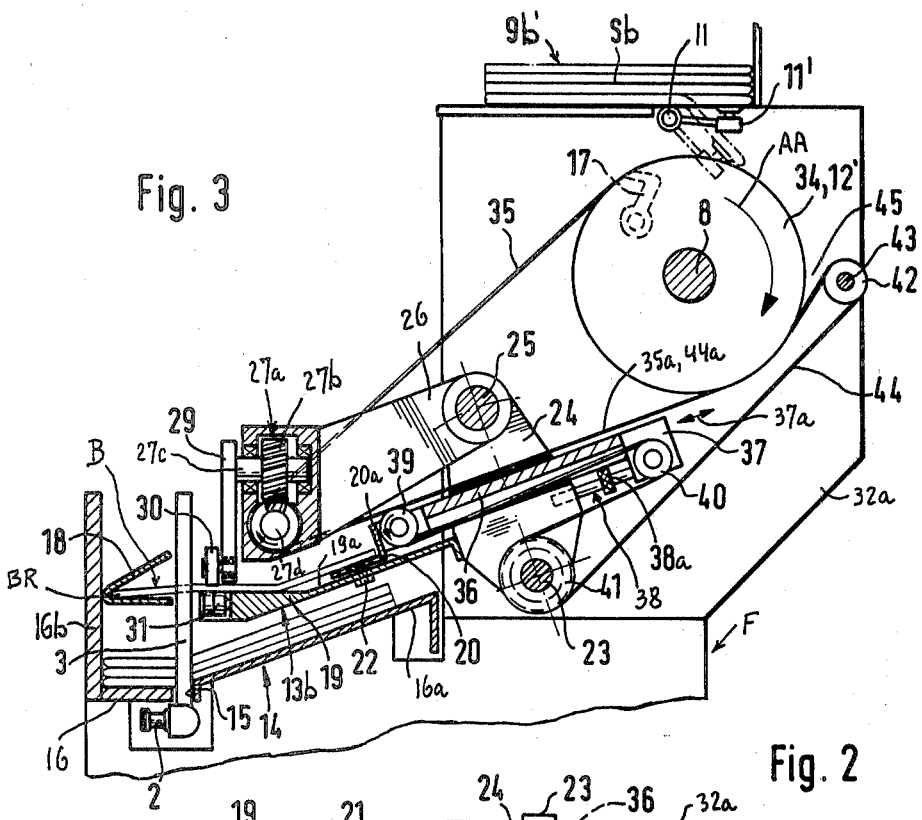
FIG. 3 is a vertical sectional view as seen in the direction of arrows from the line III—III of FIG. 2.

Each of the supports or platforms 13a, 13b, 13c comprises three portions or sections, namely, a substantially V-shaped marginal guide portion 18 which is affixed to the flange 16b of the track 14 and is disposed at one side of the path of prongs 3 with the upper reach 2a of the chain 2, an intermediate portion 19 which is located at the other side of the path of prongs 3 with the upper reach 2a of the chain 2, and a marginal guide portion or section 20 which is remote from the path of the prongs 3 and is adjustably affixed to the intermediate portion 19 by screws or bolts 22 extending through elongated slots 21 of the portion 20 and into tapped bores of the portion 19. Such adjustability of the marginal guide portion 20 relative to the portion 19 renders it possible to adapt each of the platforms 13a to 13c for proper reception and guidance of relatively wide or narrower sheets B. The portion 20 has a substantially L-shaped cross-sectional outline and is located at that side of the respective platform 13a, 13b or 13c which is nearer to the associated transfer member 12'. As shown in FIG. 3, a sheet B which is properly supported by the illustrated platform 13b is flanked by the upstanding leg 20a of the marginal guide portion 20 on the right-hand side while its back BR extends into the space between the two mutually inclined plates of the marginal guide portion 18. Thus, when the width of the platform 13b shown in FIG. 3 is properly adjusted so that it is most satisfactory for proper guidance of sheets B, a sheet which rests on the sheet-supporting upper side or surface 19a of the platform 13b is properly guided along each of its two longitudinally extending edges and is highly unlikely to change its orientation during acceleration in the direction which is indicated by the arrow A. Such acceleration is effected or completed by the oncoming prong 3 which pushes the sheet B off the surface 19a of the platform 13b and onto the partially assembled pile of sheets therebelow, namely, on the upper side of the track 14.

The intermediate portion 19 of each platform is mounted on two parallel levers 24 which are pivotably mounted on trunnions 23 installed in the adjacent portions of the frame F. The trunnions 23 are parallel to the main shaft 8. The intermediate portion 19 is secured to the median portions of the levers 24 and the upper end portions of such levers are rigidly connected to each other by a horizontal shaft or crosshead 25 extending in parallelism with the main shaft 8. The shaft 25 supports two arms 26 which extend toward the path of movement of the prongs 3 with the upper reach 2a of the chain 2 and whose free end portions carry gear boxes 27 for drive means 27a including worm drives. The worm wheels 27b of the two drive means 27a have shafts 27c which extend from the respective gear boxes 27 and support the first end portions of links 29 for the respective end portions of a combined accelerating and hold-down device 30. The worms 27d of the two drive means 27a are rigid with sprocket wheels 28 which are located outside of the respective gear boxes 27 (see particularly FIG. 2) and receive torque from endless flexible elements in the form of toothed belts 35. These belts are trained over the respective sprocket wheels 28 as well as over larger wheels 34 on the main shaft 8. The combined accelerating and hold-down device 30 is an elongated rubber bar of rectangular cross section and its purpose is to temporarily engage a freshly delivered sheet B on the upper surface 19a of the respective intermediate portion 19 and to accelerate such sheet in the direction which is indicated by the arrow A so as to reduce the likelihood of damage to the trailing edge face of such sheet by the oncoming prong 3 of the chain 2. The links 29 are parallel to each other and their second end portions are articulately connected with the respective end portions of the device 30. The just described mounting of the links 29 ensures that the sheet-engaging surface or underside 30a of the device 30 is always parallel with the upper reach 2a of the chain 2 so that the underside 30a of the device 30 can frictionally engage the upper side of a sheet B therebelow as soon as such sheet is properly accommodated on the respective platform 13a, 13b or 13c and not later than when such sheet is engaged by the oncoming prong 3. The device 30 does not change its orientation while travelling along an endless (second) path in response to rotation of the links 20 about the axes of the respective worm wheels 27b. The arrangement is preferably such that the speed of movement of the device 30 in the direction of arrow A approximates or even matches the speed of the upper reach 2a of the chain 2 when the device 30 is sufficiently close to the respective intermediate portion 19 to engage the upper side of a sheet B, i.e., while device 30 travels along a predetermined portion of its endless path. The elongated rectangular shape of the underside 30a of the device 30 prevents any undesirable changes in orientation of the sheet B therebelow while such sheet is accelerated to or at least close to the speed of the chain 2 preparatory to engagement of its rear edge face by the oncoming prong 3. The device 30 also prevents any lifting of the sheet B therebelow above and away from the surface 19a of the intermediate portion 19. It has been found that such combined hold-down and accelerating devices contribute to orderly transfer of large, small, wide or narrow sheets B from the platforms 13a, 13b, 13c onto the track 14 therebelow.

Each intermediate portion 19 carries a set of idler rollers 31 which are recessed into its upper side or surface and are located below the respective accelerating device 30 so that they reduce the likelihood of pronounced frictional engagement between a sheet B and the surface 19a of the portion 19 while the respective device 30 travels along the lowermost portion of its endless path and its underside 30a is in the process of accelerating the sheet B therebelow. The apices of the idler rollers 31 can extend slightly above the surface 19a of the intermediate portion 19 to further reduce the likelihood of pronounced or even moderate frictional engagement between a sheet B and the portion 19 while the sheet B is accelerated by the respective device 30.

Each shaft 25 has an end portion 25a which extends through an opening or window 32 in the adjacent plate-like frame member 32a and is articulately connected with the piston rod of a fluid-operated (e.g., pneumatically operated) lifting device here shown as a cylinder and piston unit 33. The latter is mounted on the frame member 32*a* (see FIG. 2) and can be actuated to pivot the levers 24 about the respective trunnions 23 (in a clockwise direction, as viewed in FIG. 3) to thereby lift the arms 26, the gear boxes 27, the device 30 and the portions 19, 20 above and away from the track 14 so as to afford convenient access to the partly accumulated piles on the sections 16 and 16*a*.

The feature that the belts 35 receive motion from the sprocket wheels 34 on the main shaft 8 ensures proper synchronization of movements of the combined hold-down and accelerating devices 30 with the movement of prongs 3 in the slot 15 of the track 14. The undersides 30*a* of the devices 30 engage the sheets B therebelow shortly before such sheets are engaged by the oncoming prongs 3.

In accordance with a further feature of the invention, the toothed belts 35 contribute component parts (sheet advancing elements) of discrete sheet guiding devices which prevent misorientation of sheets B on their way from the respective magazines 9*a*', 9*b*', 9*c*' to the associated platforms or supports 13*a*, 13*b*, 13*c*. More particularly, the just mentioned guiding devices are arranged to properly guide successive sheets B during travel from the rotary transfer members 12' on the main shaft 8 onto the upper sides or surfaces 19*a* of intermediate portions 19 of the respective platforms 13*a*, 13*b* and 13*c*.

The levers 24 which are pivotable on the aforediscussed trunnions 23 are formed with elongated U-shaped grooves 36 for reciprocable plates 37 which are movable lengthwise of the respective grooves 36 by shifting devices 38 in the form of screws each having one end portion rotatably mounted in the corresponding plate 37 and its threaded portion in mesh with a tapped bore of the correspoding lever 24 or vice versa. Alternatively, each shifting device 38 may comprise an elongated shank with two sets of oppositely inclined threads and a knurled wheel 38*a* therebetween. One set of threads mates with a tapped bore in the corresponding lever 24 and the other set of threads mates with a tapped bore in the respective plate 37. This ensures that the plate 37 is moved in a direction to the right or to the left (see the double-headed arrow 37*a* in FIG. 3) in response to rotation of the wheel 38*a* in the one or the other direction.

Each plate 37 constitutes a carrier for two freely rotatable pulleys or sprocket wheels (hereinafter called pulleys) 39 and 40. An endless sheet advancing flexible element 44 in the form of a smooth-surfaced or toothed belt is trained over the pulleys 30, 40 as well as over additional pulleys 41, 42. The pulley 41 is coaxial with the respective trunnion 23, and the pulley 42 is mounted on a shaft 43 carried by the frame member 32*a*. A portion of the belt 44 bears against the external surface of the adjacent portion of the respective toothed belt 35 so that the two neighboring parallel reaches 35*a*, 44*a* of the belts 35, 44 travel in the same direction and at the same speed (namely, at the peripheral speed of the rotary transfer member 12') during transport of successive sheets B from the associated transfer members 12' onto the corresponding intermediate portions 19. Thus, the belts 35 drive the associated belts 44, and the speed of the just mentioned parallel neighboring reaches 35*a*, 44*a* matches the speed of travel of successive sheets B from the magazines 9*a*', 9*b*', 9*c*' toward the surfaces 19*a* of the corresponding intermediate portions 19. The reaches 35*a*, 44*a* of the pairs of belts 35, 44 define elongated (third) paths for the transport of sheets B onto the respective intermediate portions 19, and such third paths extend transversely of the (first) path of movement of prongs 3 with the upper reach 2*a* of the chain 2 and are parallel or substantially parallel to the supporting surfaces 19*a* of the respective intermediate portions 19. This greatly reduces the likelihood of misorientation of sheets B during transport from the magazines 9*a*' to 9*c*' to the respective platforms 13*a* to 13*c*. The reference character 45 denotes in FIG. 3 a substantially wedge-like inlet which is defined by the belts 35, 44 at the receiving end of the respective path for advancement of sheets from the transfer member 12' onto the surface 19*a* of the respective intermediate portion 19.

Each pulley 39 is immediately adjacent to the mobile or adjustable marginal guide portion 20 of the respective platform 13*a*, 13*b* or 13*c*. Thus, the reach 44*a* of the belt 44 extends all the way to the upwardly extending leg 20*a* of the adjustable marginal guide portion 20 and ensures that a sheet B which advances with the reaches 35*a*, 44*a* is properly guided all the way to the very instant when its trailing edge is free to descend onto the surface 19*a* of the intermediate portion 19.

A sheet B which has been removed from the magazine 9*a*', 9*b*' or 9*c*' by the respective transfer member 12' (i.e., by the gripper or grippers 17 on such transfer member) is caused to enter the inlet 45 and to be engaged by the reaches 35*a*, 44*a* of the belts 35, 44 whereby the sheet is compelled to advance along a predetermined (third) path all the way onto the respective platform 13*a*, 13*b* or 13*c*, i.e., the sheet is properly guided during the entire interval of advancement of its back BR into the bight of the panels of the marginal guide portion 18. Consequently, each sheet is positively held or guided by the respective suction cup 11', by the respective gripper or grippers 17, and by the respective belts 35, 44. Thereafter, the sheet is accelerated by the respective device 30 and is entrained by the oncoming prong 3 to be transferred from the platform 13*a*, 13*b* or 13*c* onto the partially grown pile of sheets on the track 14. As stated above, the adjustability of the marginal guide portion 20 with reference to the portion 19 of each platform renders it possible to properly select the width of the spaces which are defined by the platforms so that each such space can snugly receive and guide a sheet B during acceleration by the respective device 30 and ensuing removal by the oncoming prong 3 of the chain 2. The devices 30 are remote from the respective idler rollers 31 while a sheet B is engaged and guided by the respective reaches 35*a*, 44*a* so that the devices 30 cannot interfere with entry of sheets into the spaces which are defined by the respective platforms. The arrangement is preferably such that the device 30 descend and accelerate the sheets therebelow shortly before the rear or trailing edges of such sheets are engaged by the arriving prongs 3. The speed of movement of the underside 30*a* of each drive 30 during engagement with a sheet B therebelow can be readily selected in such a way that it almost matches or is only slightly less than the speed of the prongs 3. This ensures that an oncoming prong 3 can catch up with the freshly accelerated sheet but is unlikely to damage or deface such sheet. The portions 18 and 20 guide the sheets during transfer onto the track 14, and the flange 16*b* of the track 14 guides the piles of sheets during transport along the upper sides of sections 16 and 16*a* of the track 14. This practically eliminates the possibility of misorientation of sheets B during transport along the platforms 13*a*, 13*b*, 13*c* and/or during transport along the track 14. It has been found that the just described machine prevents misorientation of sheets during transport from the magazines 9a' to 9c' and all the way to the discharge end of the track 14 even if such sheets are transported at an elevated speed, namely, a speed which at least matches or exceeds (even greatly exceeds) the maximum speed of transport of sheets in heretofore known gathering machines.

The feature that the speed of the reaches 35a, 44a matches the peripheral speed of the rotary transfer members 12' ensures that the resistance of air to rapid transfer of sheets onto the platforms 13a to 13c cannot produce a braking action which would be likely to adversely influence the timing of arrival of sheets B into the spaces defined therefor by the respective platforms and hence the cooperation of the devices 30 with the prongs 3 to ensure proper coordination of acceleration of sheets with the transfer of sheets from the platforms onto the track 14.

The improved machine is susceptible of many modifications without departing from the spirit of the invention. For example, the sheet guiding devices which include the belts 35 and 44 can be replaced by other devices which can positively guide the sheets between the transfer members 12' and the respective platforms. The illustrated guiding devices are preferred at this time because they are simple, reliable and inexpensive. Moreover, each belt 35 can serve the dual function of forming part of the respective sheet guiding device as well as of transmitting torque to the respective worm wheel 27b. The feature that the pulleys 39 are closely adjacent to the upright legs 20a of the portions 20 ensures that each and every sheet B is properly guided during the entire interval of transport from the respective transfer member 12' onto the surface 19a of the associated platform. The aforediscussed feature that the reaches 35a, 44a of the belts 35, 44 are parallel or substantially parallel to the upper surfaces of the intermediate portions 19 (or to parts of such surfaces) is desirable and advantageous because it further reduces the likelihood of a change in orientation of the sheets during entry into the spaces which are provided therefor by the platforms 19a, 19b and 19c. The just discussed feature also distinguishes the improved gathering machine from previously known machines wherein the sheets are deposited (normally dropped) onto, rather than pushed along, the platforms prior to assumption of optimum positions for transfer onto the track, i.e., onto the partly assembled piles of sheets.

As mentioned hereinabove, the improved gathering machine can be equipped with the combined accelerating and hold-down devices 30 and with rigid one-piece platforms or supports. Alternatively, the gathering machines may embody the improved adjustable platforms or supports 13a to 13c but need not necessarily embody the improved devices 30 (for example, the devices 30 can be replaced with combined accelerating and hold-down devices of the type disclosed in the aforementioned copending application Ser. No. 094,321). It has been found that the operation of the gathering machine is particularly reliable if it embodies all of the features which are shown in the drawing, i.e., adjustable platforms which can accept wider or narrower sheets B as well as the improved elongated bar-shaped devices 30. This greatly reduces the likelihood of misorientation of sheets, even if the sheets are very large and consist of a lightweight material.

The mounting of devices 30 on parallel links 29 which are articulately connected with the respective devices 30 and are rotatable about parallel horizontal axes extending at right angles to the direction (arrow A) of travel of prongs 3 with the upper reach 2a of the chain 2 has been found to constitute a very simple and reliable way of ensuring that the movements of devices 30 along their endless (second) paths can be properly synchronized with the operation of the transfer wheels 12'. The feature that the belts 35 which indirectly drive the links 29 also form part of sheet guiding devices between the transfer wheels 12' and the respective platforms 13a–13c ensures that the timing of delivery of sheets B into the range of devices 30 is not affected by changes in the speed of the machine, i.e., by changes in the speed of the main shaft 8. Thus, the operation of the transfer wheels 12' is always synchronized with movements of the devices 30 into and from engagement with the sheets B therebelow because the belts 35 receive motion from the shaft 8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine for gathering sheets into piles or similar accumulations, the combination of a conveyor having a plurality of spaced-apart entraining means arranged to move in a predetermined direction and along a first predetermined path; a succession of supports adjacent to said path and disposed one after the other, as considered in said direction, each of said supports having a sheet supporting surface and a pair of longitudinal marginal guide portions extending in parallelism with said direction and disposed at the opposite sides of said first path, each supporting surface being disposed between the respective marginal guide portions; transfer means operable to deliver sheets to the surfaces of said supports so that the delivered sheets extend into said path and are removed from the supports by the oncoming entraining means; sheet accelerating devices, one for each of said supports and each movable along an endless second path at a level above the supporting surface of the respective support, said second paths having predetermined portions which are sufficiently close to the respective supporting surfaces to enable the accelerating devices to frictionally engage the sheets on such supporting surfaces, each of said devices having an elongated sheet-engaging surface which is at least substantially parallel to said direction, at least during travel of said devices along said predetermined portions of the respective second paths; means for influencing friction between said supports and the sheets in the regions of said predetermined portions of the respective second paths so that said surfaces of said devices are free to move the sheets with reference to the respective supports during travel along said predetermined portions of the respective second paths; drive means operable to move said devices along the respective second paths so that said devices move in said direction during travel along said predetermined portions of the respective second paths; and means for operating said drive means in synchronism with said transfer means so that each of said devices engages and accelerates a freshly delivered sheet on the surface of the respective support not later than on engagement of such sheet by an oncoming entraining means.

2. The combination of claim 1, wherein each of said elongated sheet-engaging surfaces has a substantially rectangular outline.

3. The combination of claim 1, wherein at least one guide portion of each support is movable substantially transversely of said direction with reference to the other guide portion of the respective support to thereby change the effective width of the corresponding supporting surface.

4. The combination of claim 1, further comprising sheet guiding devices interposed between said transfer means and said supports and defining for the sheets predetermined third paths along which the sheets advance from said transfer means onto the respective supports.

5. The combination of claim 4, wherein said transfer means comprises a rotary transfer member for each of said supports and means for rotating said transfer members at a predetermined peripheral speed in a direction to advance sheets toward the respective sheet guiding devices, each of said sheet guiding devices comprising at least one sheet advancing member and means for driving the advancing member at a second speed at least approximating said peripheral speed and in a direction to advance sheets along the respective third path.

6. The combination of claim 5, wherein each of said sheet guiding devices comprises at least one pair of sheet advancing members each of which includes an endless flexible element, the flexible elements of each of said pairs having neighboring sheet-engaging reaches moving at said second speed.

7. The combination of claim 6, wherein said flexible elements of each of said pairs define inlets for entry of sheets which are advanced by the respective transfer members into the range of the corresponding neighboring reaches.

8. The combination of claim 6, wherein said reaches of said flexible elements define said third paths and said third paths have discharge ends closely adjacent to the respective supports.

9. The combination of claim 6, wherein each of said sheet supporting surfaces is disposed in a predetermined plane and said reaches are at least substantially parallel to the planes of the respective sheet supporting surfaces.

10. The combination of claim 6, wherein each of said sheet guiding devices further comprises pulleys for the respective flexible elements and one pulley for one element of each pair is adjacent to the respective support, and further comprising means for shifting said one pulley of each of said sheet guiding devices with reference to the associated support.

11. The combination of claim 10, wherein said shifting means includes means for moving said one pulley of each of said sheet guiding devices substantially in the longitudinal direction of the respective third path toward and away from the associated support.

12. The combination of claim 4, wherein one guide portion of each of said supports is adjustable with reference to the other guide portion of the respective support so as to enable said supports to accommodate sheets having different dimensions, said one portion of each of said supports being adjacent to the respective third path.

13. The combination of claim 1, wherein said conveyor further comprises an elongated slotted track interposed between said first path and said platforms, said entraining means being arranged to transfer sheets from successive platforms onto said track and to thereupon advance the sheets along said track.

14. The combination of claim 13, further comprising means for lifting portions of said platforms above and away from said track.

15. The combination of claim 1, further comprising means for moving said supports with reference to said conveyor.

16. In a machine for gathering sheets into piles or similar accumulations, the combination of a conveyor having a plurality of spaced-apart entraining means arranged to move in a predetermined direction and along a first predetermined path; a succession of supports adjacent to said path and disposed one after the other, as considered in said direction, each of said supports having a sheet supporting surface; means for moving said supports with reference to said conveyor, including means for pivoting said supports about axes which are substantially parallel to said direction; transfer means operable to deliver sheets to the surfaces of said supports so that the delivered sheets extend into said path and are removed from the supports by the oncoming entraining means; sheet accelerating devices, one for each of said supports and each movable along an endless second path at a level above the supporting surface of the respective support, said second paths having predetermined portions which are sufficiently close to the respective supporting surfaces to enable the accelerating devices to frictionally engage the sheets on such supporting surfaces, each of said devices having an elongated sheet-engaging surface which is at least substantially parallel to said direction, at least during travel of said devices along said predetermined portions of the respective second paths; means for influencing friction between said supports and the sheets in the regions of said predetermined portions of the respective second paths so that said surfaces of said devices are free to move the sheets with reference to the respective supports during travel along said predetermined portions of the respective second paths; drive means operable to move said devices along the respective second paths so that said devices move in said direction during travel along said predetermined portions of the respective second paths; and means for operating said drive means in synchronism with said transfer means so that each of said devices engages and accelerates a freshly delivered sheet on the surface of the respective support not later than on engagement of such sheet by an oncoming entraining means.

17. The combination of claim 16, wherein each of said supports has a pair of longitudinal marginal guide portions extending in parallelism with said direction and disposed at the opposite sides of said first path, said supporting surfaces being disposed between the respective pairs of marginal guide portions.

18. In a machine for gathering sheets into piles or similar accumulations, the combination of a conveyor having a plurality of spaced-apart entraining means arranged to move in a predetermined direction and along a first predetermined path; a succession of supports adjacent to said path and disposed one after the other, as considered in said direction, each of said supports having a sheet supporting surface; transfer means operable to deliver sheets to the surfaces of said supports so that the delivered sheets extend into said path and are removed from the supports by the oncoming entraining means; sheet accelerating devices, one for each of said supports and each movable along an endless second path at a level above the supporting surface of the respective support, said second paths having predetermined portions which are sufficiently close to the respective supporting surfaces to enable the accelerating devices to frictionally engage the sheets on such supporting surfaces, each of said devices having an elongated sheet-engaging surface which is at least substantially parallel to said direction, at least during travel of said devices along said predetermined portions of the respective second paths; means for reducing friction between the surfaces of said supports and the sheets in the regions of said predetermined portions of the respective second paths; a plurality of drive means, one for each of said devices and each operable to move the respective device along the respective second path so that said devices move in said direction during travel along said predetermined portions of the respective second paths, each of said drive means comprising a plurality of connectors having first portions articulately connected with spaced-apart portions of the corresponding accelerating devices and second portions, and means for rotating said second portions of said connectors about parallel axes to thereby move the respective accelerating devices along the corresponding endless second paths; and means for operating said drive means in synchronism with said transfer means so that each of said device engages and accelerates a freshly delivered sheet on the surface of the respective support not later than on engagement of such sheet by an oncoming entraining means, each of said rotating means comprising a first endless flexible element receiving motion from said operating means, said operating means comprising a shaft and said transfer means comprising a rotary transfer member for each of said supports, said shaft being arranged to drive said transfer members.

19. The combination of claim 18, further comprising sheet guiding devices interposed between said transfer means and said supports, said flexible elements forming part of the respective sheet guiding devices.

20. The combination of claim 18, further comprising at least one second endless flexible element for each of said supports, said first flexible elements cooperating with the respective second flexible elements to define elongated third paths along which the sheets are guided during travel from said transfer means onto the surfaces of the respective supports.

21. The combination of claim 20, wherein said first and the associated second flexible elements have neighboring reaches defining the respective third paths.

* * * * *